US008727813B2

(12) United States Patent
Yang et al.

(10) Patent No.: US 8,727,813 B2
(45) Date of Patent: May 20, 2014

(54) COMBINATION OF THIN TYPE BATTERY AND CIRCUIT BOARD

(75) Inventors: Chung-Da Yang, Miaoli County (TW); Ray-Tang Sun, Miaoli County (TW)

(73) Assignee: UER Technology Corporation, Zhunan Township, Miaoli County (TW)

( * ) Notice: Subject to any disclaimer, the term of this patent is extended or adjusted under 35 U.S.C. 154(b) by 147 days.

(21) Appl. No.: 13/566,333

(22) Filed: Aug. 3, 2012

(65) Prior Publication Data

US 2013/0178079 A1 Jul. 11, 2013

(30) Foreign Application Priority Data

Jan. 6, 2012 (TW) ..... 101200434 A

(51) Int. Cl.
*H01R 13/10* (2006.01)

(52) U.S. Cl.
USPC ..... 439/682; 439/500

(58) Field of Classification Search
USPC ..... 439/682, 629, 500
See application file for complete search history.

(56) References Cited

U.S. PATENT DOCUMENTS

| | | | | |
|---|---|---|---|---|
| 7,118,424 | B2 * | 10/2006 | Masaki et al. | 439/682 |
| 7,121,848 | B2 * | 10/2006 | Ono | 439/83 |
| 7,802,994 | B1 * | 9/2010 | Chen et al. | 439/65 |
| 8,092,236 | B2 * | 1/2012 | Yang et al. | 439/83 |

* cited by examiner

*Primary Examiner* — Hien Vu
(74) *Attorney, Agent, or Firm* — Muncy, Geissler, Olds & Lowe, P.C.

(57) ABSTRACT

A combination of a thin type battery and a circuit board is provided, including a thin type battery, a circuit board, and a joint connector. The thin type battery includes a shell body, a soft packaging cell, and an electric connector. The joint connector is disposed at the circuit board and connected electrically to a circuit of the circuit board. The soft packaging cell of the thin type battery is disposed in the shell body and includes a battery body and a top sealing area. The electric connector is connected electrically to the soft packaging cell. The electric connector can be plugged into the joint connector in a first direction or a second direction, so that the thin type battery can be plugged into the mobile electronic device through the electric connector in the first direction or second direction, to supply power.

13 Claims, 9 Drawing Sheets

COMBINATION OF THIN TYPE BATTERY AND CIRCUIT BOARD

CROSS-REFERENCES TO RELATED APPLICATIONS

This non-provisional application claims priority under 35 U.S.C. §119(a) on Patent Application No. 101200434 filed in Taiwan, R.O.C. on 2012, Jan. 6, the entire contents of which are hereby incorporated by reference.

BACKGROUND OF THE INVENTION

1. Technical Field

The present invention relates to a combination of a battery and a circuit board, and more particularly to a combination of a thin type battery and a circuit board.

2. Related Art

In recent years, the rapid development of electronic technology has exceeded popular imagination considerably. In particular, smart mobile phones and tablet computers have developed very rapidly. Before the smart mobile phones or tablet computers are released, customers usually have no knowledge of the device's functions. However, once becoming commercially available, smart mobile phones and tablet computers cause a purchase craze. Manufacturers of consumer electronics therefore, already play the role of creating market demand by supplying products according to market demand. Additionally, an emerging new electronic device can even change the social activities of many customers. For example, the widespread use of smart mobile phones with mobile Internet access has demonstrably changed the social activities of the public.

When selecting portable electronic devices, customers not only focus on high-speed Internet access and multimedia playback functions, but also pay attention to portability. To make a portable electronic device having functions analogous to those of a personal computer, in addition to the improvement of the Integrated Circuit (IC) technology, it is also necessary to further enhance the energy density of the battery. Energy density refers to the electric power supplied by a unit volume or weight of the battery. Therefore, without reducing the capacity of the battery, the energy density of the battery can be effectively enhanced by reducing the volume and weight of the battery, facilitating its application to a portable electronic device. Currently, the most widely selected power supply source for portable electronic devices is a lithium battery.

As discussed, to reduce the volume of a portable electronic device, currently some manufacturers already join a lithium battery on a main board directly in a soldering manner (for example, resistance spot welding, ultrasonic welding, laser spot welding, and a conductive medium welding type soldering). That is, the original detachable manner is changed into an undetachable manner such that the lithium battery is built directly in a portable electronic device. Although such a manner definitely reduces the volume of the portable electronic device, if a process defect occurs in the joint process (for example, a defect occurs to the lithium battery or the main board), the rework cannot be performed in accordance with the conventional design, with the result that the lithium battery and the main board must both be scrapped. Additionally, when a client sends a defective product to the factory for repair, if it is discovered that the defect only affects either the lithium battery or the main board, the rework cannot be performed either, due to the conventional fabrication manner, with the result that the lithium battery and the main board must both be scrapped.

Therefore, when soldering technology is used to connect the lithium battery and the circuit board, rework is impossible or is difficult, resulting in the necessity of an alternative solution.

SUMMARY

In view of this, the present invention provides a combination of a thin type battery and a circuit board, including a thin type battery, a circuit board, and a joint connector. The thin type battery includes a shell body, a soft packaging cell, and an electric connector. The soft packaging cell is disposed in the shell body and includes a battery body and a top sealing area. The electric connector is disposed between the shell body and the top sealing area and is connected electrically to the soft packaging cell.

The electric connector of the thin type battery includes a first insulating body and a plurality of conductive terminals. The first insulating body includes two positioning grooves and a plurality of terminal grooves. Each positioning groove has a first socket and a second socket. A first guiding groove, a second guiding groove, and a concave portion are disposed at a groove wall of each positioning groove. The first guiding groove extends from the first socket in a first direction to the concave portion. The second guiding groove extends from the second socket in a second direction to the concave portion. The plurality of terminal grooves is disposed at an interval between the two positioning grooves. Each terminal groove has a third socket and a fourth socket. The plurality of conductive terminals is individually disposed in the terminal grooves. The first socket, the second socket, the third socket, and the fourth socket are exposed from the shell body.

The joint connector disposed at the circuit board includes a second insulating body and a plurality of metal pins. The second insulating body includes two positioning boards correspondingly connected to the two positioning grooves of the electric connector. Each positioning board includes a positioning bump. The positioning bump is inserted in the concave portion from the first guiding groove or the second guiding groove to fix the second insulating body at the first insulating body. The plurality of metal pins is disposed at an interval between the two positioning boards. When the positioning bumps of the positioning boards are inserted in the concave portions, the metal pins are individually plugged in the terminal grooves to be connected electrically to conductive terminals.

Finally, the thin type battery of the present invention is plugged into, combined with, and connected electrically to a circuit board disposed with a joint connector in a first direction or a second direction, so that not only the conventional welding technology is not required, but also directional flexibility in the combination is provided.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
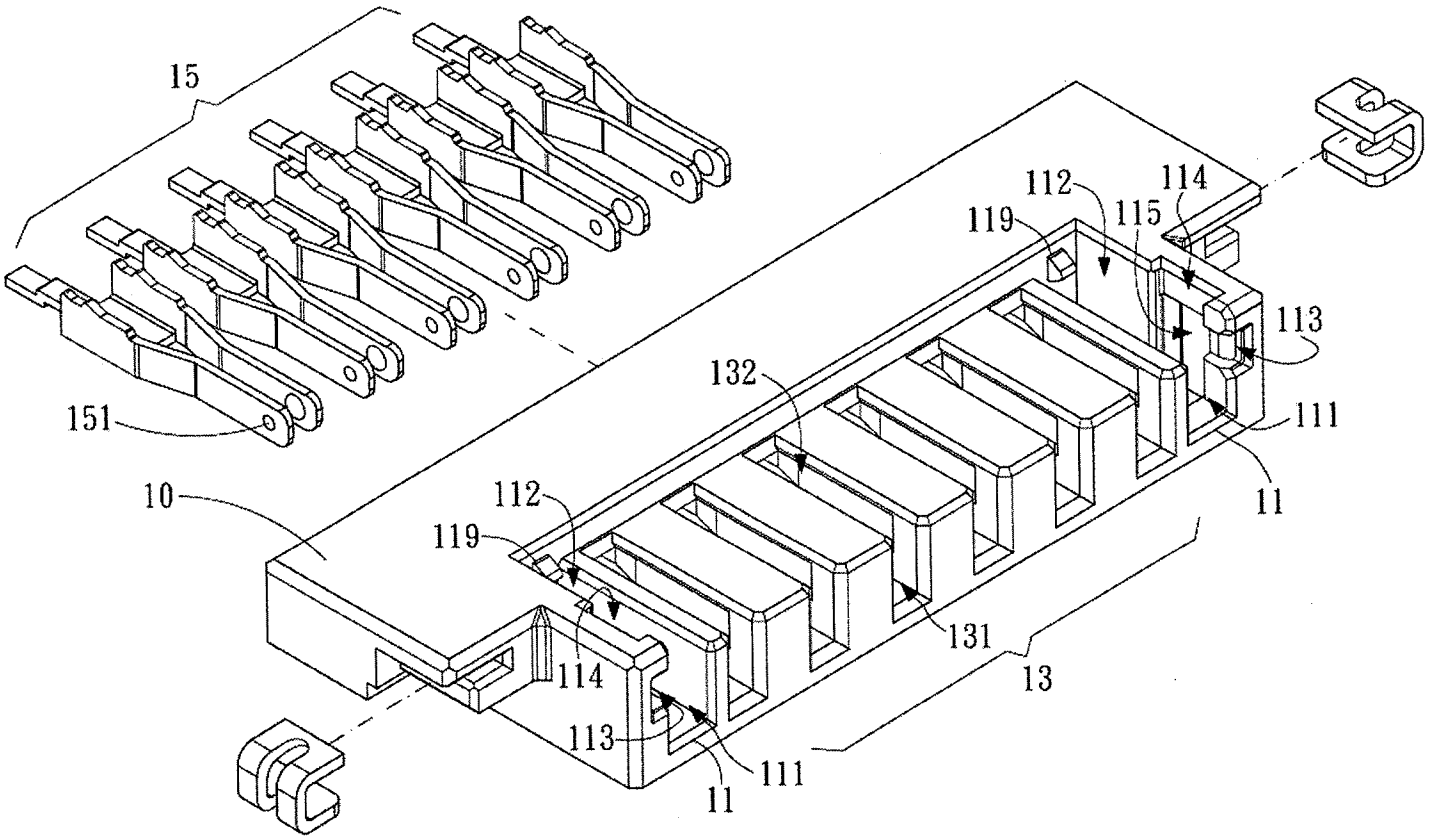
FIG. 1 is a schematic diagram (1) of an electric connector according to the present invention.

Please refer to FIG. 1 to FIG. 4, which are a schematic diagram (1), a schematic diagram (2), a schematic diagram (1) of plugging in a first direction, and a schematic diagram (2) of plugging in a second direction of an electric connector according to the present invention, respectively. The electric connector of the present invention includes a first insulating body 10 and a plurality of conductive terminals 15. The first insulating body 10 includes two positioning grooves 11 and a plurality of terminal grooves 13. Each positioning groove 11 has a first socket 111 and a second socket 112. A first guiding groove 113, a second guiding groove 114, and a concave portion 115 are disposed at a groove wall of each positioning groove 11. The first guiding groove 113 extends from the first socket 111 in a first direction 80 to the concave portion 115. The second guiding groove 114 extends from the second socket 112 in a second direction 90 to the concave portion 115. The terminal groove 13 is disposed at an interval between the two positioning grooves 11. Each terminal groove 13 has a third socket 131 and a fourth socket 132. The plurality of conductive terminals 15 is individually disposed in the terminal grooves 13.

Figure 2:
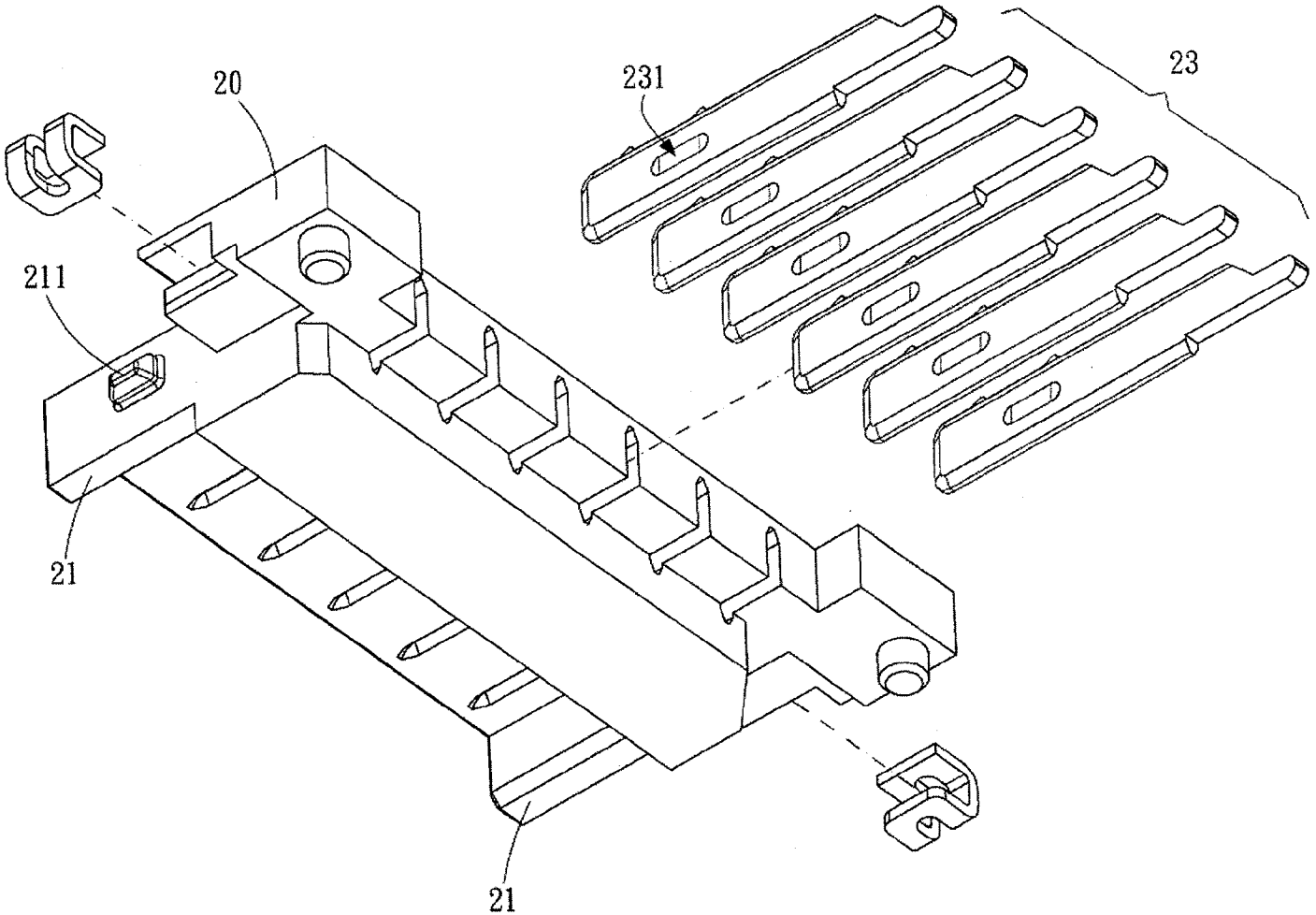
FIG. 2 is a schematic diagram (2) of an electric connector according to the present invention.
Figure 3:
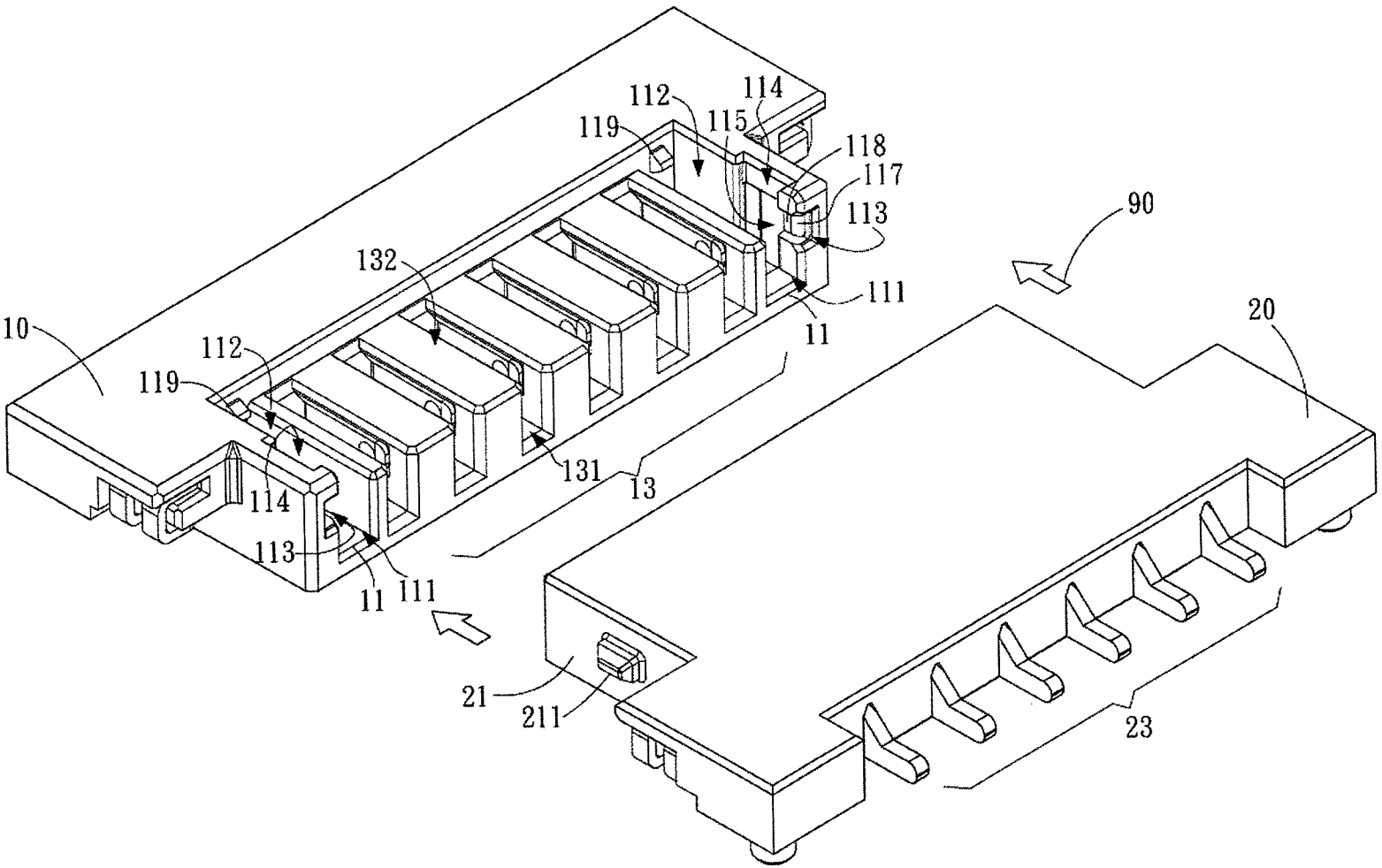
FIG. 3 is a schematic diagram (1) of plugging in a first direction of an electric connector according to the present invention.
Figure 4:
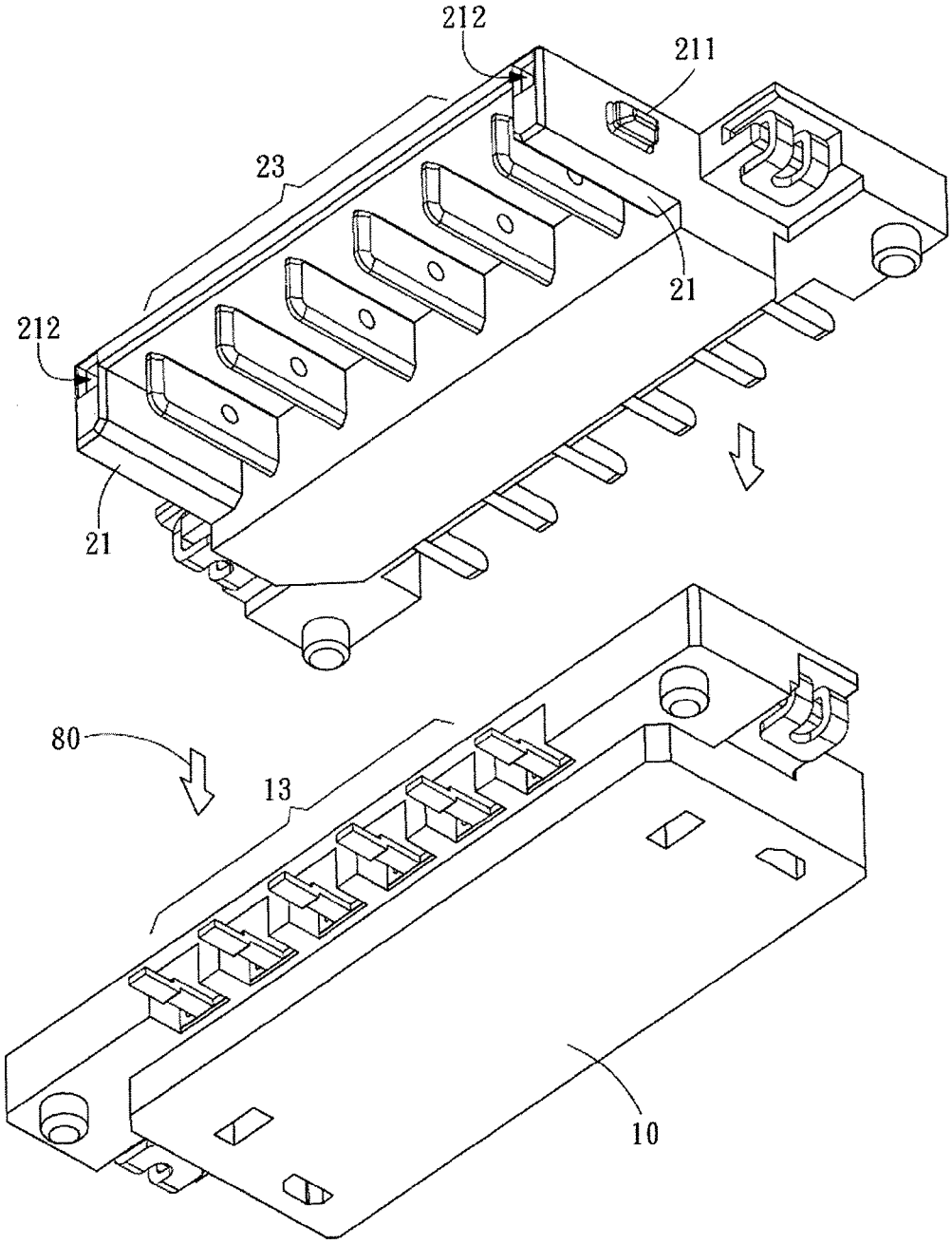
FIG. 4 is a schematic diagram (2) of plugging in a second direction of an electric connector according to the present invention.

In one implementation aspect, the electric connector of the present invention further includes a second insulating body 20 and a plurality of metal pins 23, as shown in FIG. 2. Two positioning boards 21 are included at two sides of the second insulating body 20 and are correspondingly connected to the two positioning grooves 11. Each positioning board 21 includes a positioning bump 211. The positioning bump 211 is inserted in the concave portion 115 from the first guiding groove 113 (as shown in FIG. 3), or the second guiding groove 114 (as shown in FIG. 4), to fix the second insulating body 20 at the first insulating body 10. The plurality of metal pins 23 is disposed at an interval between the two positioning boards 21. When the positioning bumps 211 are inserted in the concave portions 115, the plurality of metal pins 23 is individually plugged in the terminal grooves 13 to be connected electrically to the conductive terminals 15.

In one implementation aspect, the first insulating body 10 further includes two positioning bumps 119 separately disposed at the groove walls of the two positioning grooves 13. Each positioning board 21 further includes a positioning hole 212. When the two positioning boards 21 are correspondingly connected to the two positioning grooves 11, the two positioning bumps 119 of the first insulating body 10 are individually inserted in the positioning holes 212 of the two positioning boards 21. By disposing the positioning bumps 119, the first insulating body 10 and the second insulating body 20 do not easily rotate relative to each other when being connected, and thus are not easily detached from each other due to an external force.

In one implementation aspect, the first guiding groove 113 has a slope 117 and a plane 118 connected to the slope 117. The two positioning bumps 211 of the two positioning boards 21 are plugged from the first sockets 111, pass through the slopes 117 and the planes 118 in sequence, and are inserted in the concave portions 115.

In one implementation aspect, the second guiding groove 114 has a slope and a plane connected to the slope. The two positioning bumps 211 of the two positioning boards 21 are inserted in the concave portions 115 from the second sockets 112, the slopes, and the planes in sequence.

In one implementation aspect, a terminal bulge 151 is disposed at an end of each conductive terminal 15, and a terminal sliding groove 231 is disposed at an end of each metal pin 23. When the two positioning boards 21 are correspondingly connected to two positioning grooves 11, the terminal bulges 151 are inserted in the terminal sliding grooves 231.

Figure 5:
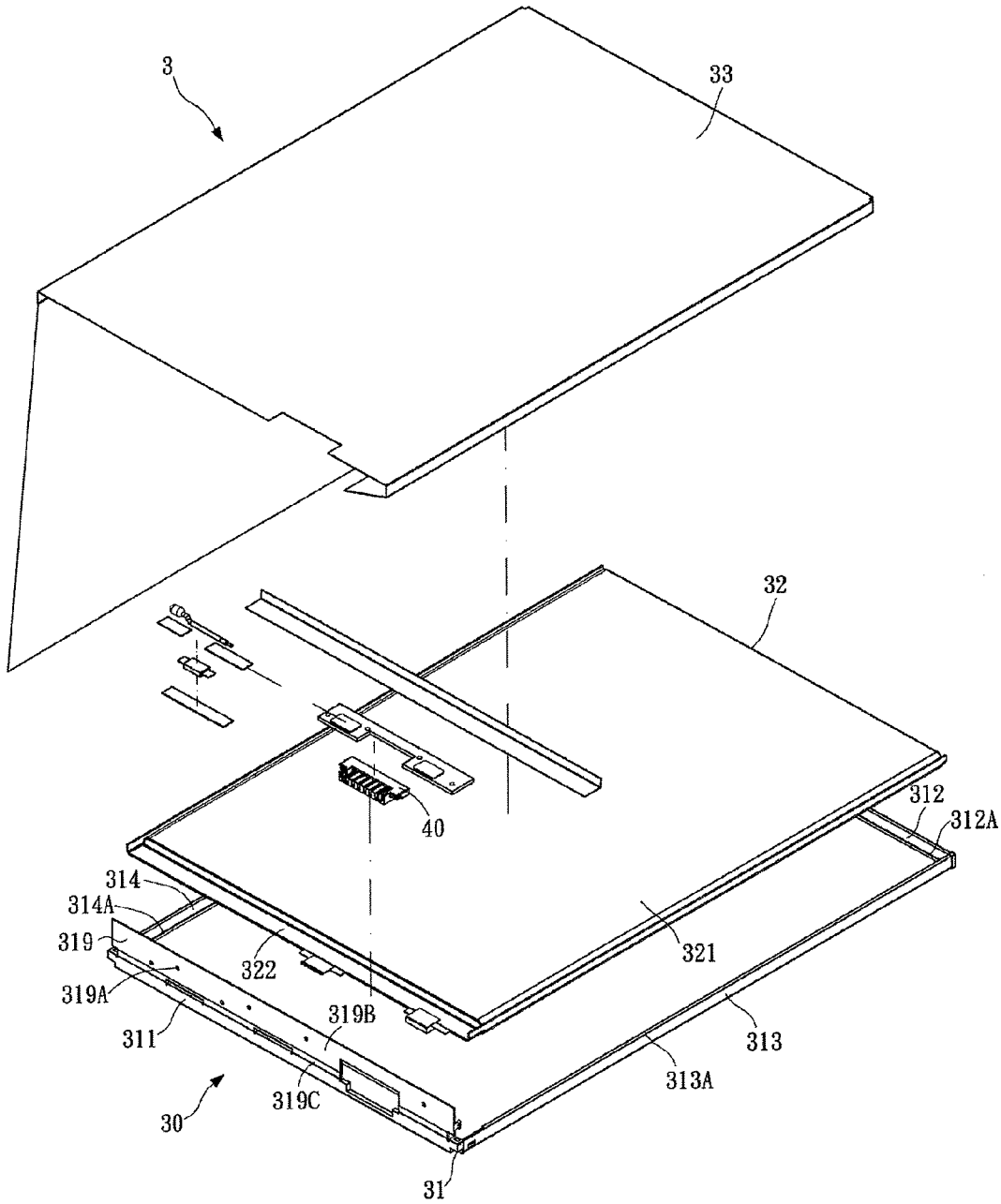
FIG. 5 is a schematic diagram (1) of a thin type battery according to the present invention.
Figure 6:
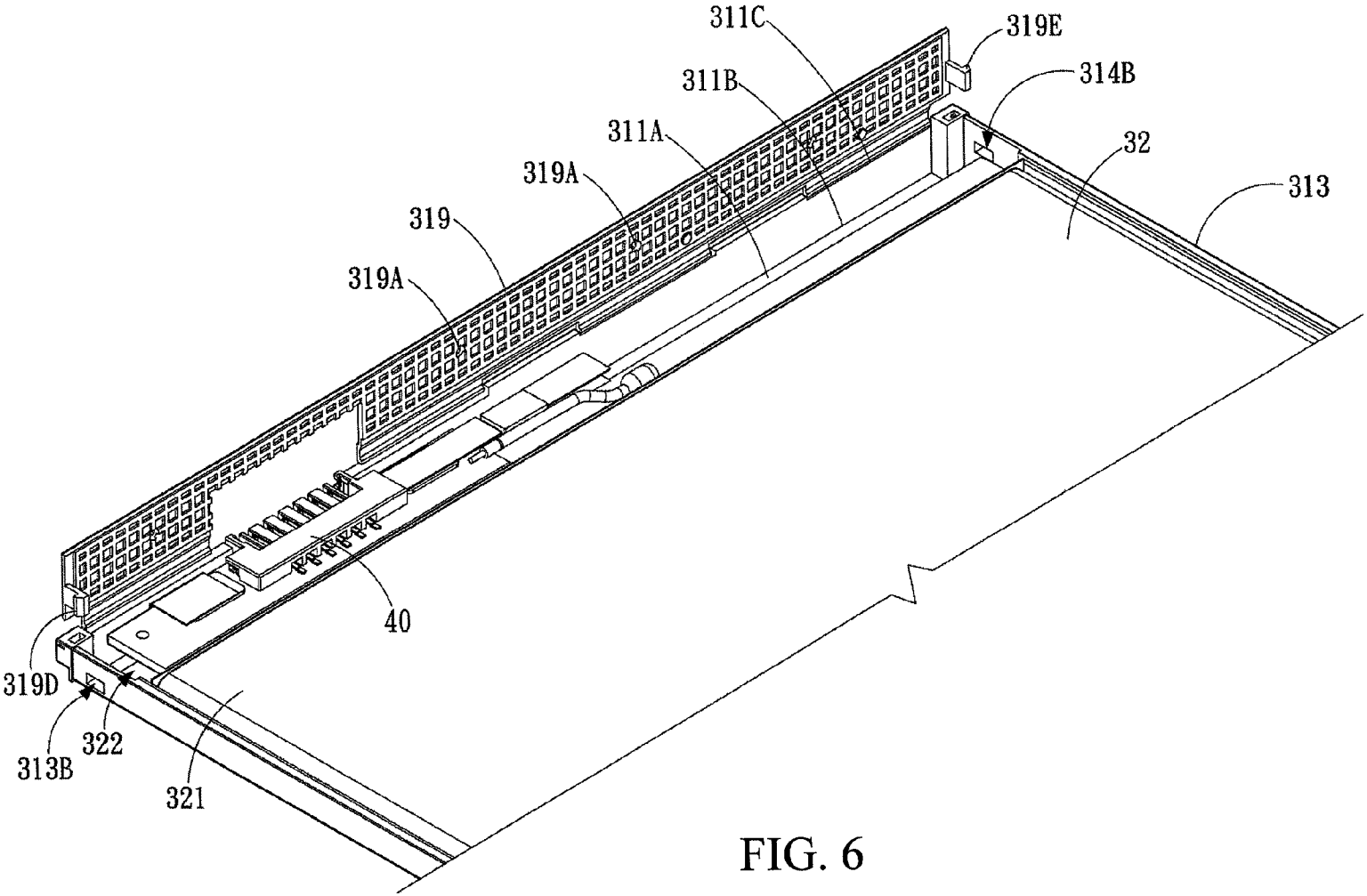
FIG. 6 is a schematic diagram (2) of a thin type battery according to the present invention.
Figure 7:
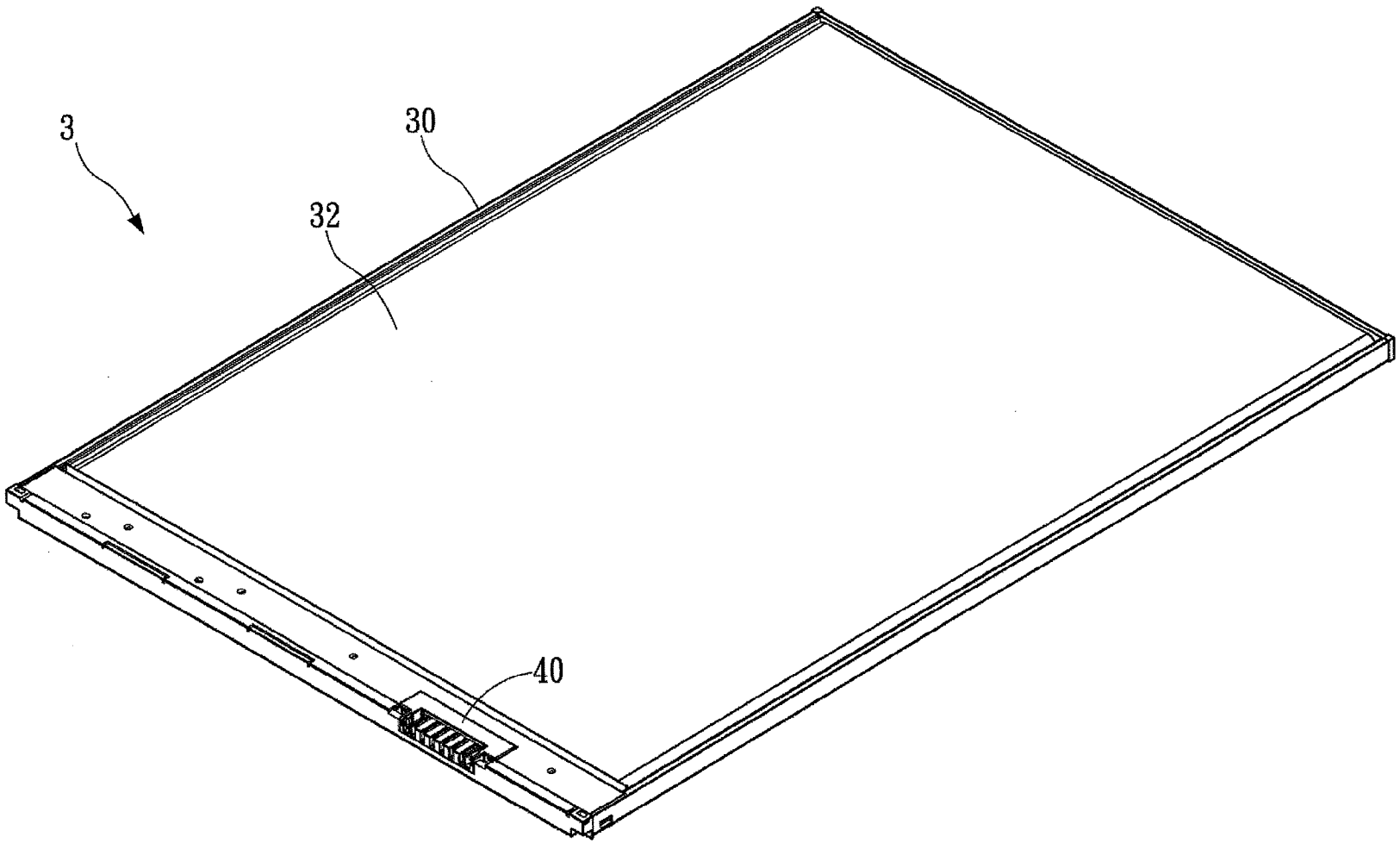
FIG. 7 is a schematic diagram (3) of a thin type battery according to the present invention.

Please refer to FIG. 5 to FIG. 7, which are schematic diagrams (1) to (3) of a thin type battery according to the present invention, respectively. The thin type battery 3 includes a shell body 31, a soft packaging cell 32, and an electric connector 40. The soft packaging cell 32 is disposed in the shell body 31 and includes a battery body 321 and a top sealing area 322. The electric connector 40 is disposed between the shell body 31 and the top sealing area 322 and connected electrically to the soft packaging cell 32. The electric connector 40 is like those described in FIG. 1 to FIG. 4 and the previous disclosures. The first socket 111, the second socket 112, the third socket 131, and the fourth socket 132 are exposed from the shell body 31.

In one implementation aspect, the shell body 30 of the thin type battery 3 includes a frame body 31 and an extending wall 319. The frame body 31 includes a first sidewall 311, a second sidewall 312, a third sidewall 313, and a fourth sidewall 314. The first sidewall 311 has a first flange 311A, a first side 311B, and a second side 311C. The first side 311B is opposite the second side 311C. The first flange 311A is connected to the first side 311B and protrudes from a surface of the first sidewall 311. The first flange 311A is used for abutting against the top sealing area 322. The second sidewall 312 is opposite the first sidewall 311. Two ends of the third sidewall 313 are connected to the first sidewall 311 and the second sidewall 312, respectively, and the third sidewall 313 has a first clamping portion 313B. The fourth sidewall 314 is opposite the third sidewall 313. Two ends of the fourth sidewall 314 are connected to the first sidewall 311 and the second sidewall 312, respectively, and the fourth sidewall 314 has a second clamping portion 314B.

The extending wall 319 is connected to the second side 311C in a bendable manner. A first clamping piece 319D and a second clamping piece 319E are provided at two ends of the extending wall 319, respectively. The first clamping piece 319D is used for clamping the first clamping portion 313B. The second clamping piece 319E is used for clamping the second clamping portion 314B. When the first clamping piece 319D and the second clamping piece 319E are clamped at the first clamping portion 313B and the second clamping portion 314B, respectively, the extending wall 319 and the first flange 311A envelop the top sealing area 322 of the soft packaging cell 32.

In one implementation aspect, the second sidewall 312 of the thin type battery 3 has a second flange 312A. The second flange 312A is used for abutting against the battery body 321. As a seal rim is provided at an edge of the soft packaging cell 32, when the soft packaging cell 32 is placed in the frame body 31, in addition to that the top sealing area 322 abuts against the first flange 311A, the second flange 312A abuts against the seal rim, so that the battery 32 is supported when being placed in the shell body 31 and at the same time the subsequent assembly process becomes easier. The second flange 312A protrudes from the second sidewall 312 by a first distance. The first distance is in a range of 0.5 mm to 2 mm. When the first distance is too small, the battery body 321 cannot be securely supported easily. When the first distance is too large, the overall thickness of the thin type battery 3 becomes larger.

In one implementation aspect, the third sidewall 313 of the thin type battery 3 has a third flange 313A protruding from the third sidewall 313 by a second distance. The third flange 313A is also used for abutting against the battery body 321. The second distance is in a range of 0.5 mm to 2 mm.

In one implementation aspect, the fourth sidewall 314 of the thin type battery 3 has a fourth flange 314A protruding from the fourth sidewall 314 by a third distance. The fourth flange 314A is also used for abutting against the battery body 321. The third distance is in a range of 0.5 mm to 2 mm.

In one implementation aspect, the extending wall 319 of the thin type battery 3 includes a first region 319B and a second region 319C. The thickness of the second region 319C is between one third and two thirds of the thickness of the first region 319B. The extending wall 319 is connected to the second side 311C with the second region 319C. As the thickness of the second region 319C is between one third and two thirds of the thickness of the first region 319B, when the extending wall 319 is bent, the compression and deformation of the material of the bendable region do not cause a bulging phenomenon to the bendable region to further affect the external size of thin type battery 3.

In one implementation aspect, the extending wall 319 has at least one hole 319A. As shown in FIG. 5 and FIG. 6, the extending wall 319 has six holes 319A. As moisture adversely influences the soft packaging cell 32, epoxy resin or other polymer materials having the effects of insulation and moisture isolation are injected in the holes 319A to envelop the top sealing area 322 of the soft packaging cell 32 to effectively prevent the moisture from intruding into the soft packaging cell 32. In addition, when cured, the polymer material also provides the thin type battery 3 with certain rigidity to bear the stress in the action of plugging. When multiple holes 319A are opened, the air inside can be easily discharged through the rest holes 319A in the process of injecting the epoxy resin.

In one implementation aspect, the thin type battery 3 further includes an adhesive tape 33, as shown in FIG. 5. The adhesive tape 33 envelops and winds external surfaces of the frame body 31 and the soft packaging cell 32 to help to fix the soft packaging cell 32 in the frame body 31.

Figure 8:
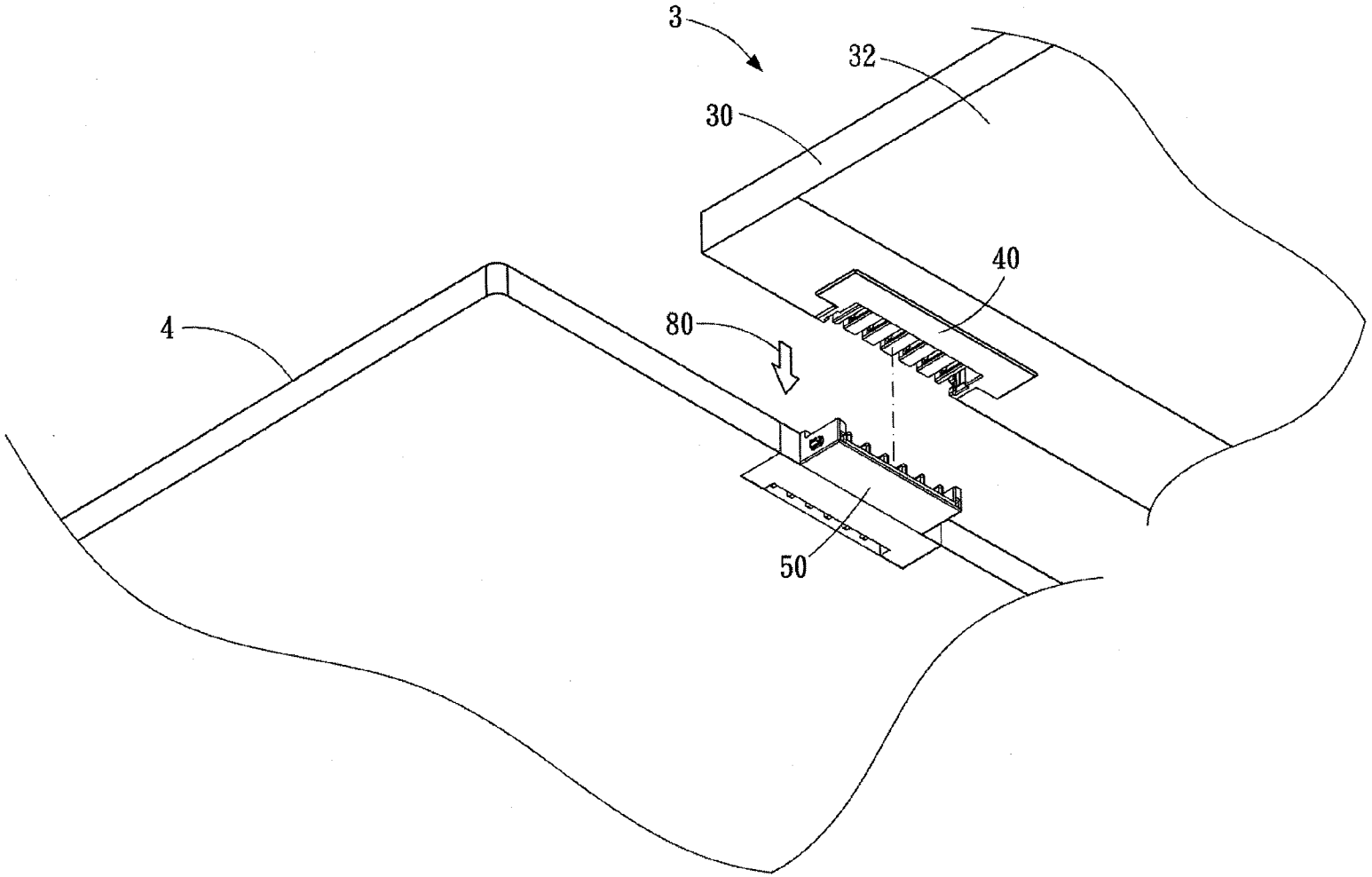
FIG. 8 is a schematic diagram (1) of a combination of a thin type battery and a circuit board according to the present invention.
Figure 9:
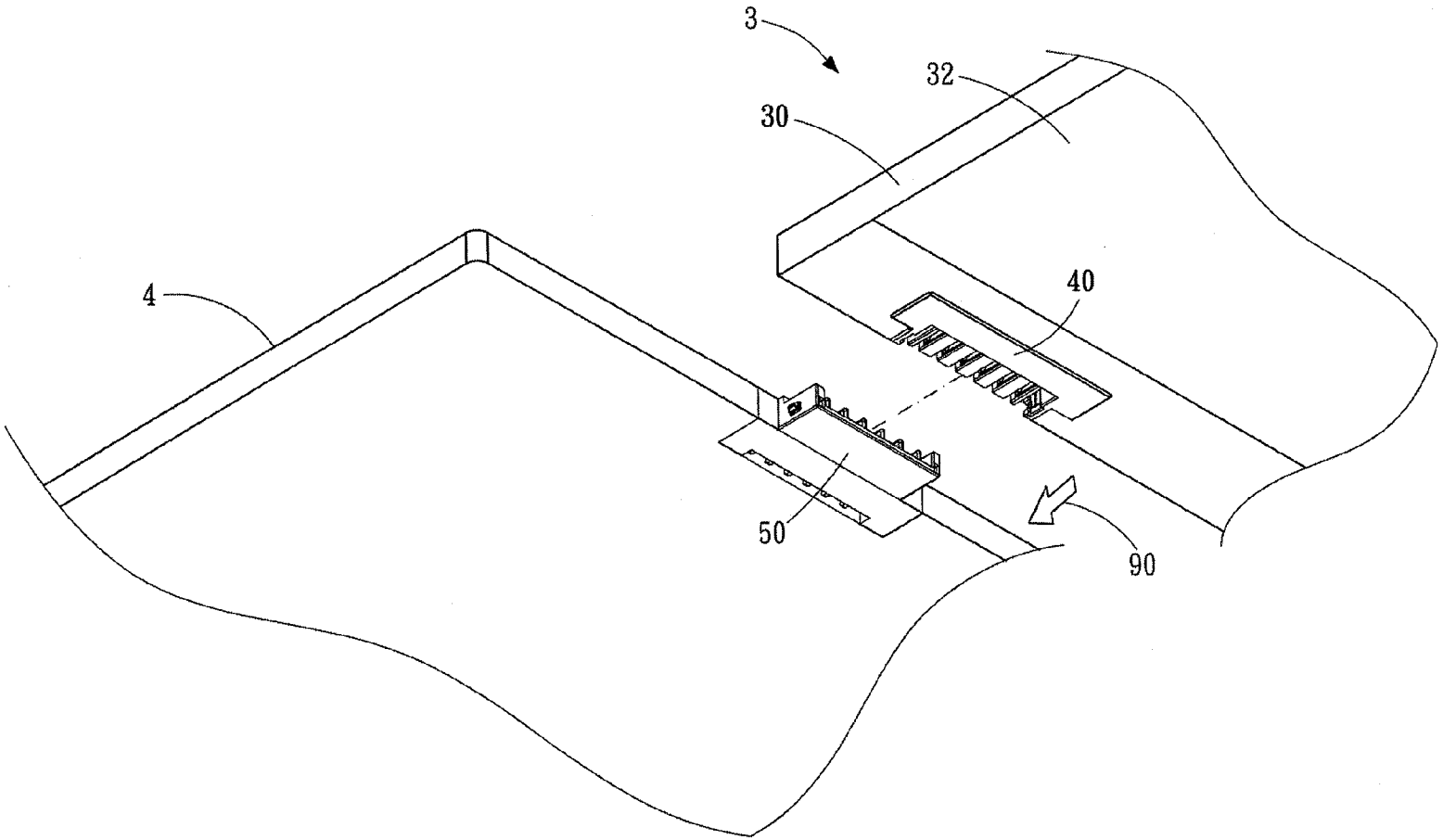
FIG. 9 is a schematic diagram (2) of a combination of a thin type battery and a circuit board according to the present invention.

Please further refer to FIG. 8 and FIG. 9, which are a schematic diagram (1) and a schematic diagram (2) of a combination of a thin type battery and a circuit board according to the present invention, respectively. The combination of a thin type battery and a circuit board of the present invention includes a thin type battery 3, a circuit board 4, and a joint connector 50. The thin type battery 3 is as discussed above, which is no longer described here. The circuit board 50 has a hollowed portion. The joint connector 50 is disposed at the hollowed portion of the circuit board 4, that is, the so-called sinking type design, so as to reduce the overall thickness.

Please refer to FIG. 1 to FIG. 4 in combination. The joint connector 50 includes a second insulating body 20 and a plurality of metal pins 23. Two positioning boards 21 are included at two sides of the second insulating body 20 and are correspondingly connected to two positioning grooves 11 of the electric connector 40. Each positioning board 21 includes a positioning bump 211. The positioning bump 211 is inserted in the concave portion 115 from the first guiding groove 113 (as shown in FIG. 3), or the second guiding groove 114 (as shown in FIG. 4), to fix the second insulating body 20 at the first insulating body 10. The plurality of metal pins 23 is disposed at an interval between the two positioning boards 21. When the positioning bumps 211 of the positioning boards 21 are inserted in the concave portions 115, the plurality of metal pins 23 is individually plugged in the terminal grooves 13 to be connected electrically to the conductive terminals 15.

Therefore, the thin type battery 3 can be plugged into, combined with, and connected electrically to the circuit board 4 disposed with the joint connector 50 in the first direction or the second direction, so that not only the conventional welding technology is not required but also directional flexibility in combination is provided. As the structural designs of the commercially available mobile electronic devices such as smart mobile phones or tablet computers are usually different for respective interests, the manners of joint and combination of the battery and the system circuit board are also varied. The combination of the thin type battery and the circuit board of the present invention can enable the thin type battery 3 to be plugged into, combined with, and connected electrically to the circuit board 4 disposed with the joint connector 50 in the first direction or the second direction, so as to be applicable to the structural designs of various commercially available mobile electronic devices.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A combination of a thin type battery and a circuit board, comprising:

a thin type battery, comprising:

a shell body;

a soft packaging cell, disposed in the shell body, and comprising a battery body and a top sealing area; and an electric connector, disposed between the shell body and the top sealing area and connected electrically to the soft packaging cell, the electric connector comprising a first insulating body and a plurality of conductive terminals, the first insulating body comprising two positioning grooves at each side thereof and a plurality of terminal grooves, each positioning groove having a first socket and a second socket, a first guiding groove, a second guiding groove, and a concave portion being disposed at a groove wall of each positioning groove, the first guiding groove extending from the first socket in a first direction to the concave portion, and the second guiding groove extending from the second socket in a second direction to the concave portion; the terminal grooves being disposed at an interval between the two positioning grooves, and each terminal groove having a third socket and a fourth socket; and the conductive terminals being individually disposed in the terminal grooves;

a circuit board; and a joint connector, disposed at the circuit board and connected electrically to a circuit of the circuit board, and comprising a second insulating body and a plurality of metal pins, the second insulating body comprising two positioning boards at each side thereof correspondingly connected to the two positioning grooves, each positioning board comprising a positioning bump, and the positioning bump being inserted in the concave portion from the first guiding groove or the second guiding groove to fix the second insulating body at the first insulating body; and the metal pins being disposed at an interval between the two positioning boards, wherein when the positioning bumps are inserted in the concave portions, the metal pins are individually plugged in the terminal grooves to be connected electrically to the conductive terminals, wherein the first socket, the second socket, the third socket, and the fourth socket are exposed from the shell body.

2. The combination of a thin type battery and a circuit board according to claim 1, wherein the first insulating body further comprises two positioning bumps separately disposed at the groove walls of the two positioning grooves; each positioning board further comprises a positioning hole, and when the two positioning boards are correspondingly connected to the two positioning grooves, the two positioning bumps of the first insulating body are individually inserted in the positioning holes of the two positioning boards.

3. The combination of a thin type battery and a circuit board according to claim 1, wherein the first guiding groove has a slope and a plane connected to the slope, the two positioning bumps of the two positioning boards are plugged from the first sockets, pass through the slopes and the planes in sequence, and are inserted in the concave portions.

4. The combination of a thin type battery and a circuit board according to claim 1, wherein the second guiding groove has a slope and a plane connected to the slope, the two positioning bumps of the two positioning boards are plugged from the second sockets, pass through the slopes and the planes in sequence, and are inserted in the concave portions.

5. The combination of a thin type battery and a circuit board according to claim 1, wherein a terminal bulge is disposed at an end of each conductive terminal.

6. The combination of a thin type battery and a circuit board according to claim 5, wherein a terminal sliding groove is disposed at an end of each metal pin, and when the two positioning boards are correspondingly connected to the two positioning grooves, the terminal bulges are inserted in the terminal sliding grooves.

7. The combination of a thin type battery and a circuit board according to claim 1, wherein the shell body comprises:

a frame body, comprising:

a first sidewall, having a first flange, a first side, and a second side, the first side being opposite the second side, the first flange being connected to the first side and protruding from a surface of the first sidewall, and the first flange being used for abutting against the top sealing area;

a second sidewall, opposite the first sidewall;

a third sidewall, having two ends connected to the first sidewall and the second sidewall, respectively, and having a first clamping portion; and a fourth sidewall, opposite the third sidewall, having two ends connected to the first sidewall and the second sidewall, respectively, and having a second clamping portion; and an extending wall, connected to the second side in a bendable manner, two ends of the extending wall respectively having a first clamping piece and a second clamping piece, the first clamping piece being used for clamping the first clamping portion, and the second clamping piece being used for clamping the second clamping portion, wherein when the first clamping piece and the second clamping piece are clamped at the first clamping portion and the second clamping portion, respectively, the extending wall and the first flange envelop the top sealing area of the soft packaging cell.

8. The combination of a thin type battery and a circuit board according to claim 7, wherein the second sidewall has a second flange protruding from the second sidewall by a first distance and used for abutting against the battery body, and the first distance is in a range of 0.5 mm to 2 mm.

9. The combination of a thin type battery and a circuit board according to claim 7, wherein the third sidewall has a third flange protruding from the third sidewall by a second distance and used for abutting against the battery body, and the second distance is in a range of 0.5 mm to 2 mm.

10. The combination of a thin type battery and a circuit board according to claim 7, wherein the fourth sidewall has a fourth flange protruding from the fourth sidewall by a third distance and used for abutting against the battery body, and the third distance is in a range of 0.5 mm to 2 mm.

11. The combination of a thin type battery and a circuit board according to claim 7, wherein the extending wall comprises a first region and a second region, the thickness of the second region is between one third and two thirds of the thickness of the first region, and the extending wall is connected to the second side with the second region.

12. The combination of a thin type battery and a circuit board according to claim 7, wherein the extending wall has at least one hole.

13. The combination of a thin type battery and a circuit board according to claim 7, wherein the circuit board has a hollowed portion, and the joint connector is disposed in the hollowed portion.

* * * * *